US005164736A

United States Patent [19]

Jemison et al.

[11] Patent Number: 5,164,736

[45] Date of Patent: Nov. 17, 1992

[54] OPTICAL ANTENNA BEAM STEERING USING DIGITAL PHASE SHIFTER CONTROL

[75] Inventors: William D. Jemison, Ambler; Peter R. Herczfeld, Philadelphia, both of Pa.; Arthur Paolella, Howell, N.J.

[73] Assignee: The United States of America as represented by the Secretary of the Navy, Washington, D.C.

[21] Appl. No.: 853,229

[22] Filed: Mar. 11, 1992

Related U.S. Application Data

[63] Continuation of Ser. No. 695,625, May 3, 1991.

[51] Int. Cl.[5] ..... H01Q 3/22

[52] U.S. Cl. ..... 342/368; 342/372

[58] Field of Search ..... 342/368, 371, 372, 377

[56] References Cited

U.S. PATENT DOCUMENTS

| | | | |
|---|---|---|---|
| 4,583,096 | 3/1986 | Bellman | 342/368 |
| 4,586,047 | 3/1986 | Inacker et al. | 342/372 |
| 4,652,883 | 3/1987 | Andricos | 342/372 |
| 4,864,310 | 9/1989 | Bernard et al. | 342/368 |
| 4,922,257 | 5/1990 | Saito et al. | 342/377 |
| 4,965,603 | 10/1990 | Hong et al. | 342/372 |

OTHER PUBLICATIONS

Wallington et al., "Optical Techniques for Signal Distribution in Phased Arrays" 645 G.E.C. Journal of Research, 1984, No. 2 London, Great Britian.

*Primary Examiner*—Gregory C. Issing

*Attorney, Agent, or Firm*—James V. Tura; James B. Bechtel; Susan E. Verona

[57] ABSTRACT

A method and system for steering an antenna beam are provided. A light source emits light wherein at least one parameter of the emitted light is modulated. Modulated light is received by an optical detector and an analog control signal is provided by the optical detector in response to the modulated parameter. The control signal is applied to an analog-to-digital converter to convert the signal from analog to digital. The digital converter output signal is applied to a digital phase shifter for controlling the phase shift of the phase shifter and thereby steering an antenna beam according to the modulated parameter. The modulated parameter may be, for example, the intensity of the emitted light or the frequency of the emitted light. A plurality of converters and phase shifters may be provided for steering of phased array antennas.

16 Claims, 5 Drawing Sheets

OPTICAL ANTENNA BEAM STEERING USING DIGITAL PHASE SHIFTER CONTROL

STATEMENT OF GOVERNMENT INTEREST

The invention described herein may be manufactured and used by or for the Government of the United States of America for governmental purposes without the payment of any royalties thereon or therefor.

This application is a continuation of application Ser. No. 07/695,625, filed May 3, 1991.

BACKGROUND OF THE INVENTION

1. Field of the Invention

This invention relates to the field of phased array antenna beam steering and in particular to optical antenna beam steering.

2. Background Art

Phased array antennas, which are used in radar and communications systems, require phase shifters at each radiating element or sub-array of radiating elements to electronically steer the antenna beam. Many types of phase shifters have been developed for phased array applications. The two main classes of phase shifters are the semiconductor phase shifter and the ferrite phase shifter. While both classes of phase shifters exhibit excellent performance when properly designed, the recent success in implementing semiconductor phase shifters in monolithic microwave integrated circuits offers the promise of significantly reducing the cost of large phased array systems. The most common type of monolithic microwave integrated circuit phase shifter is a digital phase shifter which uses the standard bit designs such as the switched line, loaded line, reflection type, and high pass/low pass sections. Many successful digital phase shifter designs have been implemented in the prior art in monolithic microwave integrated circuit form for a wide variety of operating frequencies.

Most monolithic digital phase shifters require a command in the form of an n-bit parallel binary word where n is the number of phase shifter bits. This mandates a minimum of n separate control lines for each phase shifter. Moreover, certain types of digital phase shifters require complementary control lines for each bit, thereby doubling the number of control lines required. Therefore, for large phased array systems, which may include up to ten thousand radiating elements, it is desirable to devise methods which can significantly reduce the number of control lines and/or the amount of information that must be routed to the phase shifters.

A prior art technique used to reduce the number of control lines that must be sent to each phase shifter involves the transmission of serial phase shifter data and subsequent demultiplexing and serial-to-parallel data conversion to provide the appropriate command to a number of phase shifters. A hybrid gallium arsenide optical controller recently developed by National Aeronautics and Space Administration includes a high speed digital fiber optic link, a PIN photodetector, and a MESFET demultiplexer that can distribute serial data to as many as sixteen phase shifters. This approach may be utilized in a wide variety of systems due to its compatibility with existing digital phase shifter technology. However, in this prior art system the circuitry is fairly complex and serial data rates are still high for large phased array systems. Therefore it is desirable to develop an alternate technique which uses the same philosophy of compatibility with existing phase shifter technology while requiring less complex circuitry. This alternate technique should also be compatible with the field of optical signal processing, in order to reduce beamsteering computations.

SUMMARY OF THE INVENTION

The optical antenna beam steering of the present provides an improved method for controlling a phased array antenna system of the type used in radar systems and communication systems. The optical antenna beam steering accepts a light intensity input from a fiber optic cable and converts the light intensity to a digital command in a parallel binary format which is suitable to operate a digital phase shifter. The digital shifter electronically steers the antenna beam of a phased array antenna system. The optical antenna beam steering of the present invention may be used with any conventional digital phase shifter regardless of the microwave operating frequency.

DETAILED DESCRIPTION OF THE INVENTION

Figure 1:
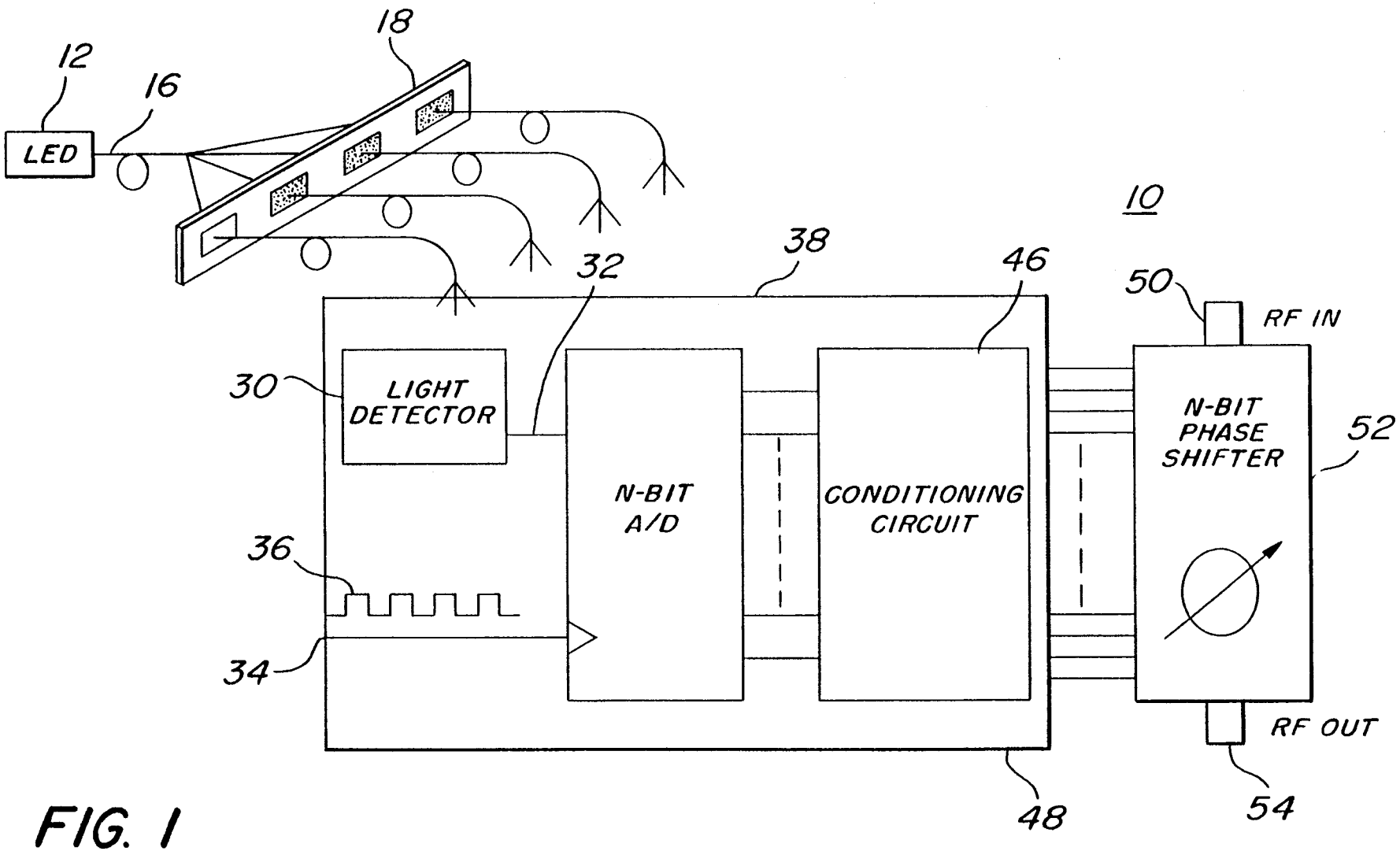
FIG. 1 shows the system for optical control of a digital phase shifter of the present invention.

Referring now to FIG. 1, there is shown optical antenna beam steering system 10 of the present invention. Optical antenna beam steering system 10 may be used to control conventional digital phase shifter 52 to electronically steer an antenna beam by conditioning a signal passing between RF input port 50 and RF output port 54 of digital phase shifter 52. Using the method of the present invention, conventional digital phase-shifters, such digital as phase shifter 52 having n-bits, may be optically controlled by intensity modulating light emitting diode 12 or laser diode 12. Alternatively, diode 12 or light source 12 may be frequency modulated to control phase shifter 52. Additionally, any other parameter of the light emitted from light source 12 may be modulated to control phase shifter 52.

The light provided by light emitting diode 12 or laser diode 12 is applied to optical fiber 16. Optical fiber 16 is branched to optical fibers 22*a–d*. Each optical fiber 22*a–d* controls an individual digital phase shifter 52, wherein only a single digital phase shifter 52 is illustrated in order to simplify the drawing. Spatial light modulator 18 varies the optical intensity of each optical fiber 22*a–d* such that when the light output of an individual optical fiber 22*a–d* is applied to a respective MESFET optical detector 30, one of 2*n* discreet MESFET output voltages is produced at the output of each optical detector 30. Each optical detector 30 is thus illuminated by a respective optical fiber 22*a–d*. Optical detector 30 may be formed using conventional monolithic microwave integrated circuit technology.

Analog-to-digital converter 38 receives encode command signal 36 by way of encode command line 34 and converts the discrete output voltages to an n-bit parallel binary word. The n-bit binary word provided by analog-to-digital converter 38 is applied to conditioning circuit 46. Conditioning circuit 46 provides an interface between the output of analog-to-digital converter 38 and the input of phase shifter control circuitry 52. Encode command signal 36 may be distributed optically by way of a separate optical fiber (not shown). Signal 36 is sent to converter 38 each time a change in the phased array beam position is desired.

The output of conditioning circuit 46 drives phase shifter control circuitry 52 to a desired phase state as indicated by encode command signal 36 applied to analog-to-digital converter 38 by way of encode command line 34. In this manner, the intensity level of the incident optical input from light emitting diode 12 sets phase shifter 52 to the desired state. This technique is compatible with existing phase shifter technology and is independent of the operating frequency of a phased array. Optical antenna beam steering system 10 may therefore be used to condition an RF signal transmitted from RF input 50 to RF output 54 of phase shifter 52 in accordance with modulation of a parameter of the light energy provided by light source 12.

MESFET optical detector 30, analog-to-digital converter 38, and conditioning circuitry 46 may be integrated into single monolithic microwave integrated circuit chip 48. Monolithic microwave integrated circuit analog-to-digital converters such as analog-to-digital converter 38 are well known in the prior art. However, because a maximum of seven bits is required for analog-to-digital converter 38 within optical antenna beam steering system 10 of the present invention, beam steering system 10 puts much less strain on analog-to-digital technology than prior art systems which required a larger number of bits.

Optical antenna beam steering system 10 of the present invention requires proper design of the analog fiber optic link provided by optical fiber 16 as well as proper design of analog-to-digital converter 38. Unlike purely digital prior art systems, where the digital commands were issued directly from a beam steering computer, optical antenna beam steering system 10 derives the digital command from the quantization of an analog electrical signal which is obtained from the output of MESFET optical detector 30. Therefore, the effects of noise must be considered on both the ability to issue a correct phase shifter command signal and the resulting phased array beam pattern in the event of an incorrect command. It will be understood by those skilled in the art that a design tradeoff exists between the noise level and the analog-to-digital quantization level of optical antenna beam steering system 10.

The ability to accurately control digital phase shifter 52 within optical antenna beam steering system 10 depends on the analog-to-digital input noise level on converter input line 32 as well as the precision to which the analog-to-digital input voltage can be optically controlled. The analog-to-digital input noise contains contributions from the fiber optic link consisting of light emitting diode 12, spatial light modulator 18, and MESFET photodetector 30. Setting the analog-to-digital input to a desired discrete voltage level depends primarily on the resolution of spatial light modulator 18 and the characteristics of MESFET optical detector 30.

It will be understood by those skilled in the art that the intensity of the light applied to MESFET optical detector 30 may be modulated by modulating the bias current of light emitting diode 12 or by means of spatial light modulator 18 for the purpose of controlling the phase shift of digital phase shifter 52. Additionally, as previously described, it will be understood by those skilled in the art that rather than controlling the phase shift of phase shifter 52 by modulating the intensity of the light provided by light emitting diode 12, the phase shift of digital phase shifter 52 may be controlled by frequency modulation of the light applied to optical cable 16 by light emitting diode 12. The frequency of the light applied by light emitting diode 12 may be modulated by any of the conventional frequency modulation methods known in the art. Additionally, it will be understood by those skilled in the art that MESFET light detector 30 must be optimized for optical antenna beam steering system 10 using frequency modulated light rather than intensity modulated light.

The transfer function of analog-to-digital converter 38 is a simple staircase function wherein the quantization voltage level, q, of the transfer function is determined by:

$$q = \frac{V_{FS}}{2^n} \qquad \text{Equation (1)}$$

In Equation (1) $V_{FS}$ is the full scale analog-to-digital input voltage range of analog-to-digital converter 38 and n is the number of digital output bits of analog-to-digital converter 38 corresponding to a discrete voltage level applied to the input of converter 38.

The probability that a correct phase shifter command or analog-to-digital output signal will be provided on converter output lines 40 of analog-to-digital converter 38, in the presence of Gaussian noise, can be derived as:

$$P_r(-(k^- \cdot 5)q \leqq v \leqq (k^+ \cdot 5)q) = \int_{(k^- \cdot 5)q}^{(k^+ \cdot 5)q} \frac{1}{\sqrt{2\pi}\ \sigma_N} \exp\left(-\frac{(v' - v)}{2\sigma_a{}^N}\right) dv \qquad \text{Equation (2)}$$

for $0 \leqq k \leqq n$.

In Equation (2) k is the number of quanta in the output of analog-to-digital converter 38, 94 $^2{}_N$ is the noise variance, and v' is the value of the discrete level of analog-to-digital converter 38 input voltage.

Since the analog-to-digital output statistics are identical for each k, Equation (2) is valid for any signal on the output of analog-to-digital converter 38. Furthermore, when it is assumed that the input voltage v' of analog-to-digital converter 38 may be controlled to be within the desired quantization range (i.e., $-q/2 < v' < q/2$ for $k=0$), the probability of issuing a correct command to digital phase shifter 52 may be expressed as:

$$P_r\left(\begin{matrix}\text{correct}\\ \text{command}\end{matrix}\right) = \frac{1}{2}\left\{ erf\left(\frac{\frac{q}{2} - v}{\sqrt{2}\ \sigma_N}\right) + erf\left(\frac{\frac{q}{2} + v}{\sqrt{2}\ \sigma_N}\right)\right\} \qquad \text{Equation (3)}$$

Figure 2:
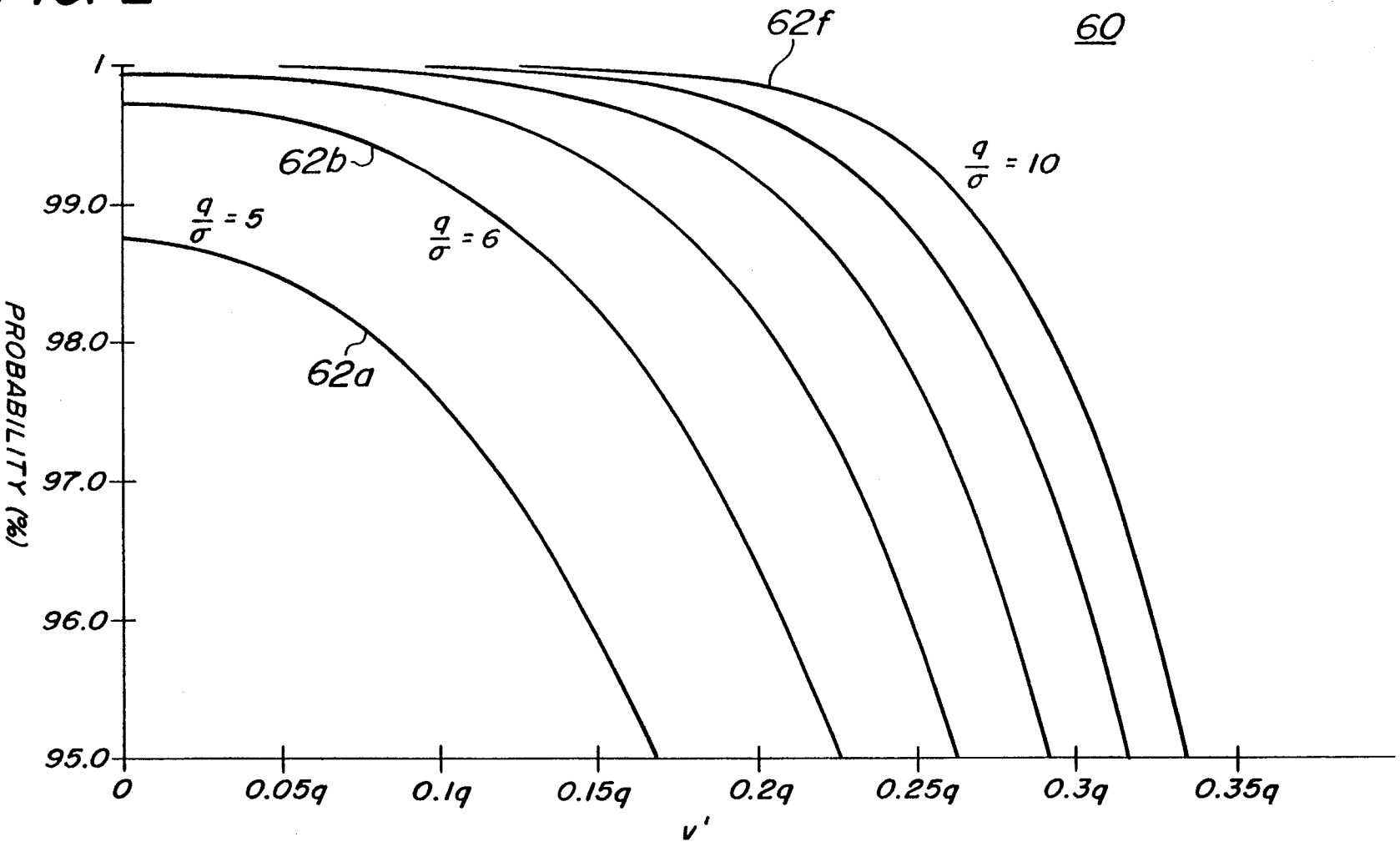
FIG. 2 shows graphical representative of the probability of obtaining a correct phase shifter command as a function of the normalized value of the input voltage of the analog-to-digital converter of FIG. 1.

Referring now to FIG. 2, there is shown graphical representation 60 determined in accordance with Equation (3). Equation (3) is symmetric about zero volts and is plotted for values of v' between 0 and 0.4 q for different values of $\sigma^2_N$ to provide curves 62*a–f* of graphical representation 60. The probability of generating a correct phase shifter command within optical antenna beam steering system 10 for a fixed $v^1$ increases with increasing $q/\sigma_N$ as shown by curves 62*a–f*. Alternatively, given a fixed noise level within optical antenna beam steering system 10, the input voltage applied to analog-to-digital convertor 38 may be set to a predetermined percentage of kq to obtain a desired probability that a correct phase shifter command will be applied to digital phase shifter 52.

For example, the input voltage must be set to within ±q/4 of kq for $q/\sigma_N=10$ to obtain greater than a ninety-nine percent probability of obtaining a correct command within system 10. Since the noise within system 10 is a function of optical intensity due to the properties of MESFET optical detector 30, the noise level used in the calculation should correspond to that which is expected under full optical illumination.

Figure 3:
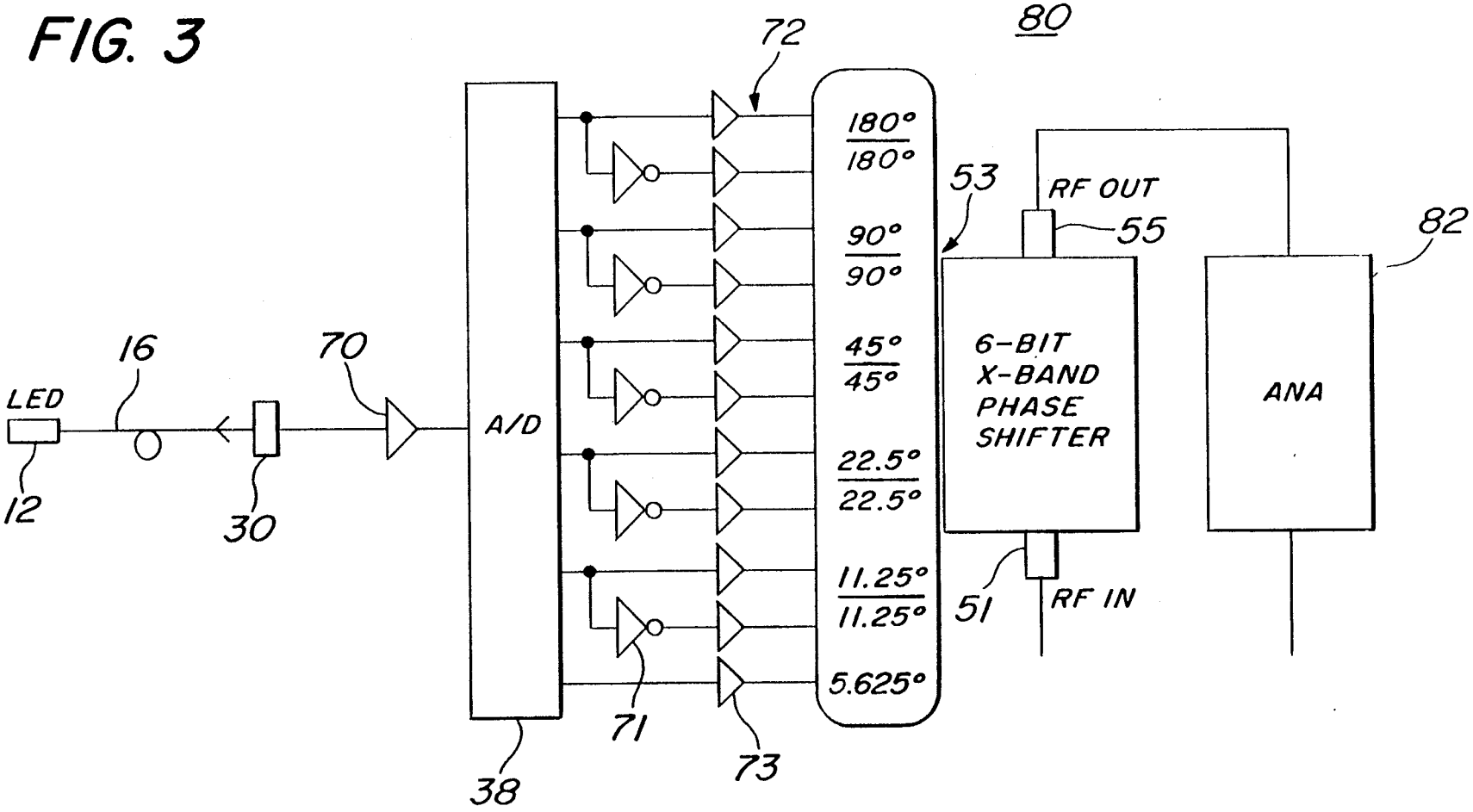
FIG. 3 shows an optical antenna beam steering system for digital phase shifter control of the invention of FIG. 1.

Referring now to FIG. 3, there is shown optical system 80 including six-bit X-band digital phase shifter 53 having RF input terminal 51 and an RF output terminal 55. Light emitting diode 12, coupled by way of optical fiber 16, may be adapted to operate at approximately eight hundred thirty nanometers to provide a source of optical energy in optical antenna beam steering system 80. The core (not shown) and cladding (not shown) diameters of multimode optical fiber 16 may be approximately one hundred micrometers and one hundred and forth micrometers respectively. MESFET optical detector 30 may have a one millimeter gate length and a three hundred micrometer gate width. Optical detector 30 may have four seventy-five micrometer gate fingers and is operated in the common source configuration near pinchoff (Vgs= −2.4 V) for optimum light responsivity.

Optical fiber 16 of beam steering system 10 is positioned over the active area of optical detector 30 using a micropositioner (not shown) to achieve maximum optical coupling between optical fiber 16 and optical detector 30. Inverting operational amplifier 70, which may have a gain of approximately forty, scales the output voltage of optical detector 30 to the ten volt input range of analog-to-digital converter 38. The six most significant bits of a conventional twelve-bit parallel analog-to-digital converter may be used to effectively provide six-bit analog-to-digital converter 38 with an associated quantization level of one hundred fifty six millivolts.

Since the inputs of digital phase shifter 52 require control voltages of zero or negative six volt control voltages, level shifting using inverting operational amplifier circuitry 72 is provided. Inverting operational amplifier circuitry 72 interfaces the output of analog-to-digital converter 38 to digital phase shifter 52. Circuitry 72 includes logic inverters 71 to provide the complementary voltages along with inverting amplifiers 73 to provide the zero to negative six volt range required by digital phase shifter 52. The phase shift of phase shifter 52 within optical antenna beam steering system 80 may be measured using analyzer 82.

Figure 4:
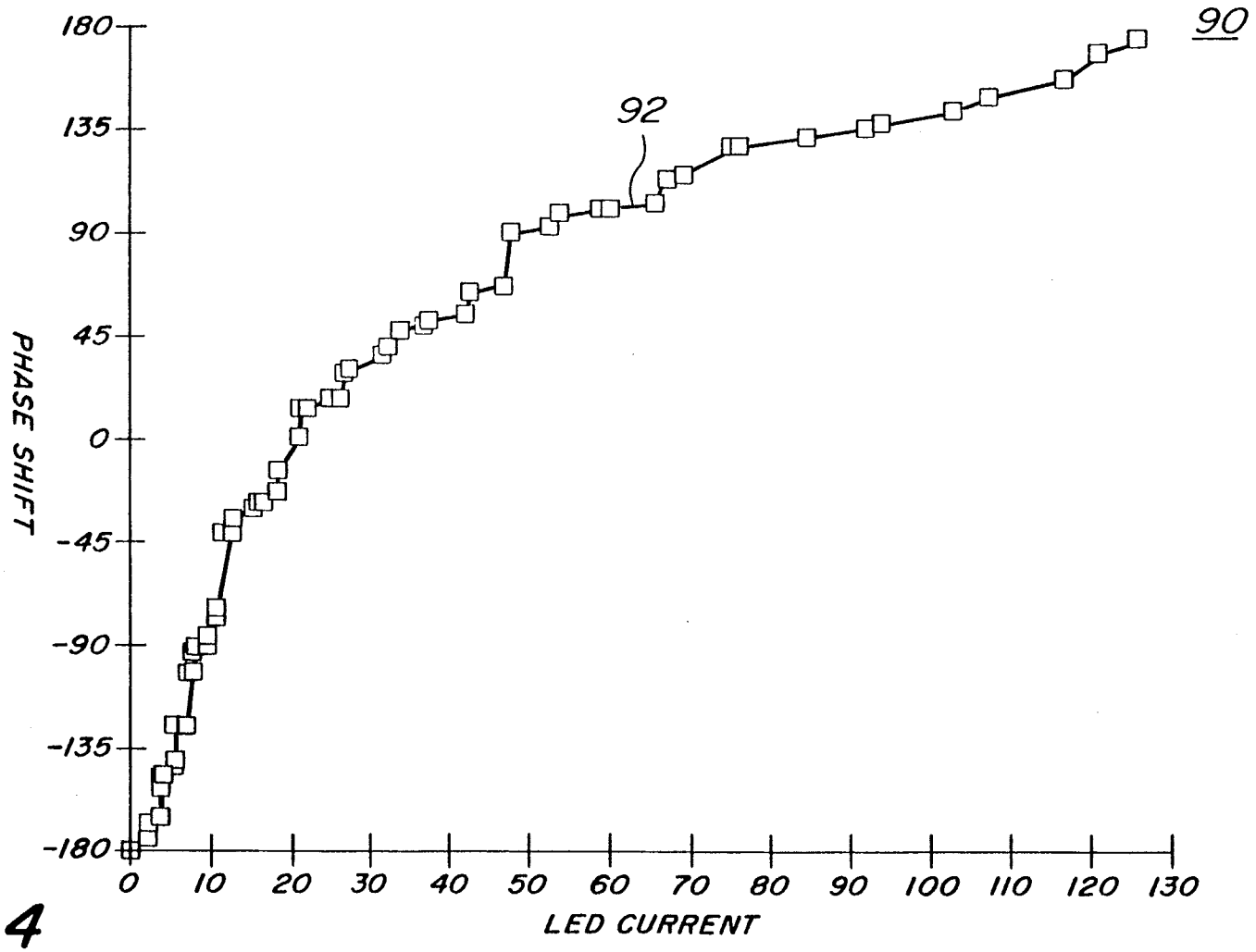
FIG. 4 shows a graphical representation of the amount of phase shift produced within the phase shifter of a FIG. 1 as a function of the bias current of the light emitting diode of FIG. 1.

Referring now to FIG. 4, there is shown graphical representation 90. Curve 92 of graphical representation 90 shows the amount of phase shift provided by digital phase shifter 52 as a function of the bias current of light emitting diode 12 or laser diode 12. In optical antenna beam steering system 80 of the present invention, the intensity of light applied to optical detector 30 by way of optical fiber 16 may be controlled using spatial light modulator 18. The nonlinear response provided by digital phase shifter 52, as represented by nonlinear curve 92, is due to the transfer function between light emitting diode 12 and optical detector 30. The maximum optical power needed to control digital phase shifter 52 through all sixty-four states may be approximately three hundred and ten microwatts. It should also be noted that the computed value of $q/\sigma_N=15$ corresponds well with the experimental results.

The effects of incorrect phase shifter commands on an antenna pattern, or array factor, within optical antenna beam steering system 10 may be determined since the performance of digital phase shifter 52 controlled by the method of the present invention may be quantified. A computer simulation was performed to compute the array factor of a uniformly illuminated array (not shown) in the presence of the errors that would normally be expected in the environment in which optical antenna beam steering system 10 and optical antenna beam steering system 80 operate. Two types of errors, correlated errors and uncorrelated were considered. The simulation results verify the qualitatively expected result that antenna pattern degradation occurs only in the presence of uncorrelated errors. Specifically, an increase in the average sidelobe level is observed for uncorrelated errors while correlated errors cause a fixed phase offset across the aperture that do not cause pattern degradation.

Uncorrelated or statistically independent errors may occur due to statistically independent noise at each MESFET optical detector 30 or statistically independent noise at each pixel of spatial light modulator 18. In this case, the probability of setting all digital phase shifters 52 correctly is given by $$P_{all} = \prod_{i=1}^{N} P_c$$

Likewise, the probability that at least one digital phase shifter 52 is set incorrectly is given by:

$$P_1 = 1 - \prod_{i=1}^{N} P_c$$

Therefore, even if a high probability of issuing a correct phase shifter command signal is obtained, it is likely that phase shifter command errors will occur. This is especially true as the number of antenna elements increases. Qualitatively, it is expected that these statistically independent errors will give rise to an increase in the average sidelobe level.

Correlated phase shifter command errors could occur if noise from light emitting diode 12 or noise from laser diode 12 dominates the noise of optical detector 30. Additionally, correlated phase shift command errors could occur if correlated errors exist in spatial light modulator 18. Errors in transmissive spatial light modulator 18, for example, could be due to a temperature dependant transmissivity. Correlated errors will cause a fixed offset in all digital phase shifters 52. A fixed offset in all digital phase shifters 52 will not affect the main beam position.

Figure 5:
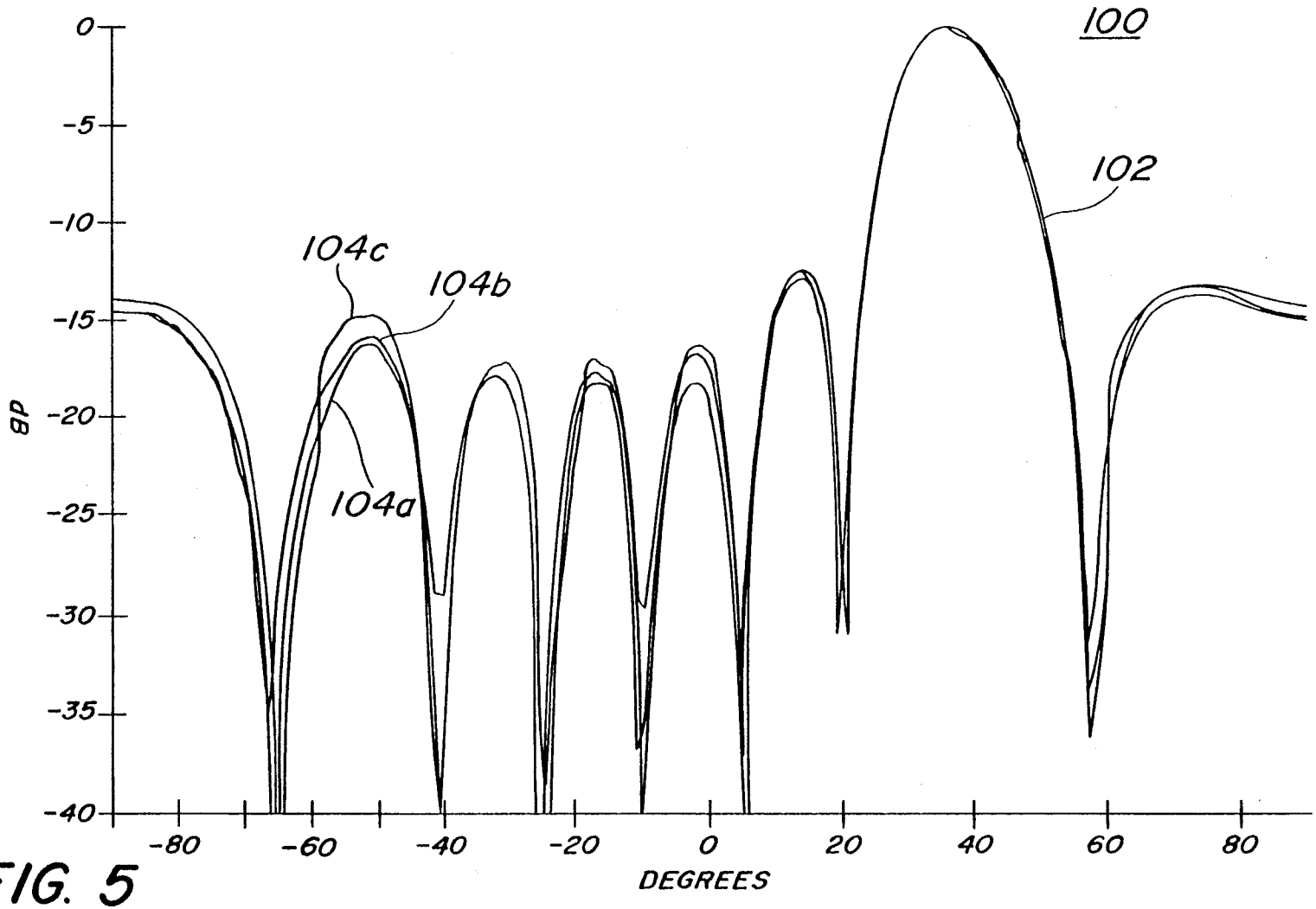
FIG. 5 shows a graphical representation of an antenna pattern in the presence of an optically induced command error causing an increase in sidelobes.

Referring now to FIG. 5, there is shown graphical representation 100. Curve 102 of graphical representation 100 is the result of a computer simulation for an eight element array (not shown) steered to thirty-seven degrees with five-bit digital phase shifters 52 in the presence of both correlated errors and uncorrelated errors. Curve 104*a* represents the ideal pattern. Curve 104*b* represents the optimum phase shifter quantization pattern. Curve 104*c* represents the optically controlled pattern with a command error. Thus it will be understood by those skilled in the art that a small increase in the sidelobes of curve 102 is produced when a command error is present.

Thus, the method of the present invention may be advantageously applied to a phased array system (not shown). As previously described, optical antenna beam steering system 10, and its associated implementation, is compatible with monolithic microwave integrated circuit technology. It is also compatible with the field of optical signal processing and existing monolithic microwave integrated circuit digital phase shifter technology. It is believed that the integration of the method of the present invention with optical signal processing techniques could significantly reduce the complexity of controlling a larger number of phase shifters in a phased array system.

Many modifications and variations of the present invention are possible in view of the above disclosure. It is therefore to be understood, that within the scope of the appended claims, the invention may be practiced otherwise than as specifically described.

We claim:

1. A system for steering an antenna beam, said system having an interface for controlling the phase shift of a plurality of phase shifters to provide a variation in said phase shift, comprising:

a single light source for emitting light wherein at least one parameter of said emitted light may be modulated;

branch means for branching said emitted light to provide a plurality of unmodulated branched emitted light paths;

a plurality of parallel light modulating optical means for independently receiving, modulating and transmitting each of said branched emitted light paths in parallel independently of any electrical conversion of light in accordance with said single light source by varying said parameter in accordance with said variation in said phase shift to provide a plurality of optical control signals;

control means for receiving said plurality of modulated and transmitted branched light paths and providing first electrical control signals in accordance with said parameter;

convertor means for receiving said first electrical control signals and providing second digital signals in response to said first electrical control signals; and, said converter means having means for applying said second digital signals to said phase shifters to control the phase shift of said phase shifters in accordance with said second digital signals wherein said plurality of phase shifters is controlled by said single light source.

2. The antenna beam steering system of claim 1, further comprising means for controlling said antenna beam in accordance with said controlled phase shift of said phase shifter.

3. The antenna beam steering system of claim 2, wherein there is provided a plurality of said interfaces and a plurality of said phase shifters for steering an array of antenna beams.

4. The antenna beam steering system of claim 1, wherein said at least one modulated parameter is the intensity of said emitted light.

5. The antenna beam steering system of claim 4, wherein said means for modulating said intensity of said emitted light comprises spatial light modulator means.

6. The antenna beam steering system of claim 1, wherein said at least one modulated parameter is the frequency of said emitted light.

7. The antenna beam steering system of claim 5, further comprising:

means for branching said emitted light to provide branched light sources;

said spatial light modulator means being adapted to modulate each branched light source of said plurality of branched light sources; and, means for applying each modulated branched light source of said plurality of modulated branched sources to a respective control means for providing a plurality of respective first electrical control signals to steer an array of antenna beams.

8. The antenna beam steering system of claim 1, wherein said converter means comprises means for receiving an analog signal and providing a digital signal in accordance with said analog signal.

9. A method for steering an antenna beam in a system having an interface for controlling the phase shift of a plurality of phase shifters to provide a variation in said phase shift, comprising the steps of:

(a) branching light emitted from a single light source to provide a plurality of branched emitted light paths wherein at least one parameter of said branched emitted light paths may be modulated;

(b) independently receiving, modulating and transmitting each of said branched emitted light paths in parallel independently of any electrical conversion of light by varying said parameter in accordance with said phase shift to provide a plurality of optical control signals;

(c) receiving said plurality of modulated branched light paths and providing first electrical control signals in accordance with said parameter;

(d) receiving said first electrical control signals and providing second digital signals in response to said first electrical control signals; and (e) applying said second digital signals in said phase shifters to control the phase shift of said phase shifters in accordance with said second digital signals wherein said plurality of phase shifters is controlled by said single light source.

10. The method for steering an antenna beam of claim 9, comprising the further step of controlling said antenna beam in accordance with said controlled phase shift of said phase shifter.

11. The method for steering an antenna beam of claim 10, comprising the further step of provided a plurality of said interfaces and a plurality of said phase shifters for controlling an array of beams.

12. The method for steering an antenna beam of claim 9, wherein said at least one modulated parameter is the intensity of said emitted light.

13. The method for steering an antenna beam of claim 12, wherein the step of modulating said intensity of said emitted light comprises applying said emitted light to spatial light modulator means.

14. The method for steering an antenna beam of claim 9, wherein said at least one modulated parameter is the frequency of said emitted light.

15. The method for steering an antenna beam of claim 13, comprising the further steps of:

(e) branching said emitted light to provide a plurality of branched light sources;

(f) modulating each branched light source of said plurality of branched light sources to provide a plurality of modulated branched light sources: and, (g) applying each modulated branched light source of said plurality of modulated branched light sources to respective control means.

16. The method for steering an antenna beam of claim 9, wherein step (c) comprises converting an analog converter input signal into a digital converter output signal.

* * * * *